US005836502A

United States Patent [19]

Kanai et al.

[11] Patent Number: 5,836,502

[45] Date of Patent: Nov. 17, 1998

[54] MOTOR DRIVEN STAPLER

[75] Inventors: Toshiyuki Kanai; Toru Yoshie, both of Tokyo, Japan

[73] Assignee: Max Co., Ltd., Tokyo, Japan

[21] Appl. No.: 796,444

[22] Filed: Feb. 10, 1997

Related U.S. Application Data

[63] Continuation of Ser. No. 462,023, Jun. 5, 1995, abandoned, which is a continuation of Ser. No. 87,872, Jul. 9, 1993, Pat. No. 5,474,222.

[30] Foreign Application Priority Data

| | | | |
|---|---|---|---|
| Jul. 10, 1992 | [JP] | Japan | P.HEI.4-207384 |
| Jul. 10, 1992 | [JP] | Japan | P.HEI.4-207385 |
| Jul. 10, 1992 | [JP] | Japan | P.HEI.4-207386 |
| Aug. 4, 1992 | [JP] | Japan | U.M.HEI4-60281 |
| Aug. 4, 1992 | [JP] | Japan | U.M.HEI4-60282 |
| Aug. 4, 1992 | [JP] | Japan | U.M.HEI4-60283 |

[51] Int. Cl.[6] ..... B25C 5/16

[52] U.S. Cl. ..... 227/131; 227/155; 227/120

[58] Field of Search ..... 227/120, 123, 227/127, 131, 135, 155

[56] References Cited

U.S. PATENT DOCUMENTS

| | | | |
|---|---|---|---|
| 4,181,298 | 1/1980 | Capdeboscq | 271/5 |
| 4,199,095 | 4/1980 | Yamanoi | 227/155 X |
| 4,227,687 | 10/1980 | Schoonmade | 271/139 |
| 4,281,785 | 8/1981 | Brooks | 227/155 |
| 4,623,082 | 11/1986 | Kurosawa | 227/131 |
| 4,720,033 | 1/1988 | Olesen | 227/131 |
| 4,993,616 | 2/1991 | Yoshie et al. | 227/131 |
| 5,009,355 | 4/1991 | Akizawa et al. | 227/131 |
| 5,029,745 | 7/1991 | Akizawa et al. | 227/131 |
| 5,076,483 | 12/1991 | Olesen | 227/155 |
| 5,181,643 | 1/1993 | Radtke | 227/131 X |
| 5,474,222 | 12/1995 | Kanai et al. | 227/131 |

FOREIGN PATENT DOCUMENTS

| | | | |
|---|---|---|---|
| 0322906 | 7/1989 | European Pat. Off. . | |
| 0475436 | 3/1992 | European Pat. Off. . | |
| 63-43027 | 11/1988 | Japan . | |
| 125672 | 5/1989 | Japan . | |
| 4129680 | 4/1992 | Japan | 227/155 |

*Primary Examiner*—Rinaldi I. Rada
*Assistant Examiner*—Boyer Ashley
*Attorney, Agent, or Firm*—Morgan, Lewis & Bockius LLP

[57] ABSTRACT

In the course of the upward turning movement of the magazine, the lowermost sheet of staples is taken from the staple cartridge as the feeding member is slidably displaced in the forward direction. Since the thrusting force given by the tension spring is sufficiently larger than the frictional resistance present between the lower surface of the lowermost sheet of staples and the feeding member, each sheet of staples can be more reliably taken from a staple cartridge. As the magazine is turned in an upward direction, a feeding member is displaced in the forward direction by the resilient force of a tension spring, and a contact portion on the feeding member comes in contact with the rear end of the lowermost sheet of staples.

5 Claims, 14 Drawing Sheets

MOTOR DRIVEN STAPLER

This is a continuation of application Ser. No. 08/087,872, filed Jul. 9, 1993, now U.S. Pat. No. 5,474,222.

This is a continuation of application Ser. No. 08/462,023, filed on Jun. 5, 1995, which was abandoned upon the filing hereof 08/796,444.

BACKGROUND OF THE INVENTION

The present invention relates to a staple feeding apparatus for taking out away from a staple cartridge the lowermost sheet-shaped staple among a plurality of sheet-shaped staples received in the staple cartridge in the multi-layered structure wherein the staple cartridge is fitted into a magazine turnably arranged in a motor driven stapler. In addition, the present invention also relates to a staple feeding mechanism for a motor driven stapler which assures that a plurality of sheet-shaped staples, received in a staple cartridge in the multi-layered structure, are successively taken from the staple cartridge to the foremost end of a magazine in order from the lowermost sheet-shaped staple among the foregoing plurality of sheet-shaped staples received in the staple cartridge.

A hitherto known staple feeding apparatus of the foregoing type is constructed such that a feeding unit, including a feeding belt or a feeding roller disposed below the bottom of a staple cartridge, is arranged in such a manner as to allow the lowermost staple, among a plurality of sheet-shaped staples received in a staple cartridge, to come in tight contact with the upper surface of the feeding belt or the feeding roller of the feeding unit. As the feeding unit is driven by an electric motor, the lowermost staple is taken from the staple cartridge to the foremost end of a magazine turnably arranged in a motor driven stapler (see, e.g., a Japanese patent examined Publication No. 1-25672).

With the conventional staple feeding apparatus constructed in the above-described manner, the intensity of feeding power required to remove each staple usually varies depending on a magnitude of the frictional resistance present between the lowermost sheet-shaped staple and the upper surface of the feeding unit. The larger the frictional resistance, the larger the feeding power required for the foregoing purpose. Thus, the lowermost staple can be reliably fed from the staple cartridge to the magazine in the presence of the high frictional resistance. Since a plurality of sheet-shaped staple cartridges received in the staple cartridge are normally forced from above by the resilient force of a spring means, a large amount of frictional resistance can be present between the adjacent upper and lower staples. Thus, a malfunction can arise where part of an adhesive, that connects adjacent straight staples to each other, adheres to the upper or lower sheet-shaped staple or a staple is partially entangled with the upper or lower sheet-shaped staple. In such a case, a higher amount of feeding power must be applied to the lowermost staple in order to reliably feed it to the magazine after this lower staple is separated from the staple located above it. In practice, the frictional resistance present between the lowermost staple and the upper surface of the feeding unit is sometimes not large enough to reliably feed the lowermost staple from the staple cartridge.

In addition, with the conventional staple feeding mechanism constructed in the above-described manner, a drawback is that it becomes complicated in structure since the driving power required for actuating the staple feeding mechanism is typically generated by the electric motor. To obviate the foregoing drawbacks a staple feeding mechanism for removing a staple from a staple cartridge when the staple comes in contact with a feeding roller in a feeding unit is made that has a ratchet mounted on one end of a roller shaft for the feeding roller, and an actuating unit. The actuating unit includes a pulling pawl and a pushing pawl and is mounted on a pair of driving links. The driving links are adapted to drive a magazine in such a manner that when the driving links are turnably displaced in the downward direction, the pulling pawl is engaged with the ratchet, and subsequently, when the driving links are turnably displaced in the upward direction, the pushing pawl is engaged with the ratchet. Thus, the ratchet rotates during the engagement of the pushing pawl with the ratchet and the staple is delivered in the forward direction by a distance corresponding to the rotation of the ratchet.

With the proposed staple feeding mechanism however, there arises a necessity for arranging an additional unit for normally biasing the actuating unit toward the ratchet so as to allow the pulling pawl to be reliably engaged with the ratchet. In addition, since the ratchet is rotated by a small angle with each working stroke of the driving links, the motor driven stapler should be repeatedly actuated until a staple can be struck by a driver when the staple cartridge is replaced with a new one.

SUMMARY OF THE INVENTION

The present invention has been made in consideration of the aforementioned background and its object resides in providing a staple feeding apparatus for a motor driven stapler which assures that the lowermost sheet-shaped staple among a plurality of sheet-shaped staples received in a staple cartridge is reliably fed to the foremost end of a magazine in the motor driven stapler while a large amount of feeding/driving power is applied to the lowermost sheet-shaped staple.

To accomplish the above object, a first aspect of the present invention provides a staple feeding apparatus for a motor driven stapler wherein a magazine fitted with a staple cartridge is turnably arranged above a base frame to turn about a support shaft in an upward and downward direction. The staple cartridge is such that a plurality of sheet-shaped staples, each having a series of straight staples successively connected to each other side by side, are received therein in the multi-layered structure, the lower ends of a front wall and a rear wall of the staple cartridge are kept opened, and when the magazine is turned in the downward direction by rotationally driving an electric motor, a straight staple located at the foremost end of each sheet-shaped staple is formed to exhibit substantially inverted U-shaped contour and then struck by a driver toward a stapling board disposed on the base frame so as to allow the foot of the staple to penetrate through the papers that are to be stapled together. The staple feeding apparatus comprises a feeding member arranged to slidably move, from an opening portion at the lower end of the rear wall of the staple cartridge, in the direction of the feeding of each sheet shaped cartridge relative to the magazine and including a contact portion adapted to come in contact with the rear end of the lowermost staple among a plurality of sheet shaped staples received in the staple cartridge in the course of the displacement of the feeding member in the forward direction and a supporting portion immovably disposed at the position behind the magazine, that the feeding member includes an engagement portion adapted to be engaged with the supporting portion so as to allow the feeding member to slidably move in the opposite direction to the direction of feeding of each sheet-shaped staple when the magazine is turned in the downward direction, and that spring means is bridged between the magazine and the feeding member so as to allow the feeding member to slidably move in the direction of feeding of each sheet-shaped staple when the magazine is turned in the upward direction and the feeding member is released from the engaged state caused by the engagement of the feeding member with the supporting portion.

As the magazine is turned in the downward direction, the engagement portion of the feeding member is engaged with the supporting portion of the magazine so that the feeding member is slidably displaced in the opposite direction to the direction of feeding of each sheet-shaped staple. This causes the contact portion, on the feeding member, to be displaced in the forward direction relative to the magazine. On the contrary, when the feeding member is released from the engagement state which is caused by the engagement of the feeding member with the supporting portion as the magazine is turned in the upward direction, the feeding member is slidably displaced in the direction of feeding of each sheet-shaped staple by the resilient force of the tension spring. This causes the contact portion on the feeding member to be displaced in the forward direction relative to the magazine. At this time, the contact portion engages with the rear end of the lowermost staple. Thus, the lowermost sheet-shaped staple is removed from the fore wall of the staple cartridge by a distance equal to the distance of the forward displacement of the contact portion of the staple cartridge inside of the rear wall.

In such manner, each sheet-shaped staple is forced by the resilient power of the tension spring applied to the rear end thereof. Incidentally, the thrusting power given by the tension spring is sufficiently larger than the frictional resistance present between the lower surface of the sheet-shaped staple and the feeding member. For this reason, even in case where the lowermost staple partially adheres to a subsequent staple located above the foregoing one or partial entanglement occurs therebetween, the lowermost sheet-shaped staple can be reliably removed from the staple cartridge by a sufficiently high force extended by the tension spring. Consequently, a plurality of sheet-shaped staples received in the staple cartridge can be successively removed without fail from the staple cartridge by repeating the foregoing steps.

In addition, the present invention has been made in consideration of the aforementioned background and its object resides in providing a staple feeding mechanism for a motor driven stapler wherein the staple feeding mechanism is simple in structure, and that the number of straight staples fed per each stroke of the driving links can substantially be increased.

To accomplish the above object, a second aspect of the present invention provides a staple feeding mechanism for a motor driven stapler wherein a magazine fitted with a staple cartridge is turnably arranged above a base frame to turn about a support shaft in an upward and downward direction. The staple cartridge is such that a plurality of sheet-shaped staples, each having a series of straight staples successively connected to each other side by side, are received in the multi-layered structure. The lower end of a fore wall of the staple cartridge and the bottom of the same are kept opened and a pair of driving links, disposed on the opposite sides of the magazine, are turnably arranged to turn about the support shaft in the upward and downward direction. When the magazine is turned via the driving links, by rotationally driving an electric motor, a straight staple, delivered to the foremost end of the magazine, is formed by a forming plate to exhibit a substantially inverted U-shaped contour and then struck by a driver so as to allow the feet of the staple to penetrate through the papers to be stapled together. A feeding roller is disposed directly below the bottom of the staple cartridge and a ratchet, operatively associated with the feeding roller, is disposed on the one side of the magazine and a ratchet lever, which is molded of a synthetic resin or the like to exhibit an inverted U-shaped contour while including a fore lever portion, and a rear lever portion, is fixedly secured to one of the driving links. A pushing pawl is formed at the foremost end of the fore lever portion of the ratchet lever and at least one pulling pawl is formed at the foremost end of the rear lever portion of the same. When the driving links are turnably driven in the downward direction, the pushing pawl on the fore lever portion of the ratchet lever engages with the ratchet, causing the latter to be stepwise rotated in the forward direction. When the driving links are turnably driven in the upward direction, the pulling pawl on the rear lever portion of the ratchet lever is brought in engagement with the ratchet, causing the latter to be likewise stepwise rotated in the forward direction. As the feeding roller, operatively associated with the ratchet, is stepwise rotated in the forward direction, each sheet-shaped staple is fed in the forward direction while coming in contact with the feeding roller.

When the driving links are turnably driven in the downward direction, the pushing pawl on the fore lever portion of the ratchet lever engage with pawl teeth on the fore side of the ratchet, causing the latter to be stepwise rotated in the forward direction. When the driving links are turnably driven in the upward direction, the magazine is turnably driven in the upward direction but the magazine is stopped in the course of the turning movement of the driving links. Since the driving links can be turnably driven further in the upward direction, the upper pulling pawl on the rear lever portion of the ratchet lever engages with the ratchet, causing the latter to be stepwise rotated in the forward direction. The ratchet is repeatedly stepwise rotated in the forward direction every time the magazine is turned in the downward direction and then turned in the upward direction, and the feeding roller is stepwise rotated in the forward direction. Thus, the lowermost staple, received in the staple cartridge, is removed from the staple cartridge and then delivered in the forward direction in the presence of frictional resistance between the lowermost staple and the feeding roller while maintaining the contact state therebetween.

Since the ratchet lever is molded of a synthetic resin or the like to exhibit an inverted U-shaped contour, there is no necessity for arranging a biasing unit for normally biasing the ratchet lever toward the ratchet side like conventional staple feeding mechanisms. Thus, in addition to the addition to an advantageous effect that the staple feeding mechanism is simple in structure, the number of each sheet-shaped staple attainable per a single working stroke of the driving links can substantially be increased since the ratchet is stepwise rotated in the forward direction every time the driving links are turnably driven.

It should be noted that when two pulling pawls are formed on the rear lever portion of the ratchet lever, the number of staples attainable per each working stroke of the driving links can substantially be increased.

DETAILED DESCRIPTION OF THE PREFERRED EMBODIMENTS

The present invention will now be described in detail with reference to the accompanying drawings which illustrate a preferred embodiment thereof.

Figure 1:
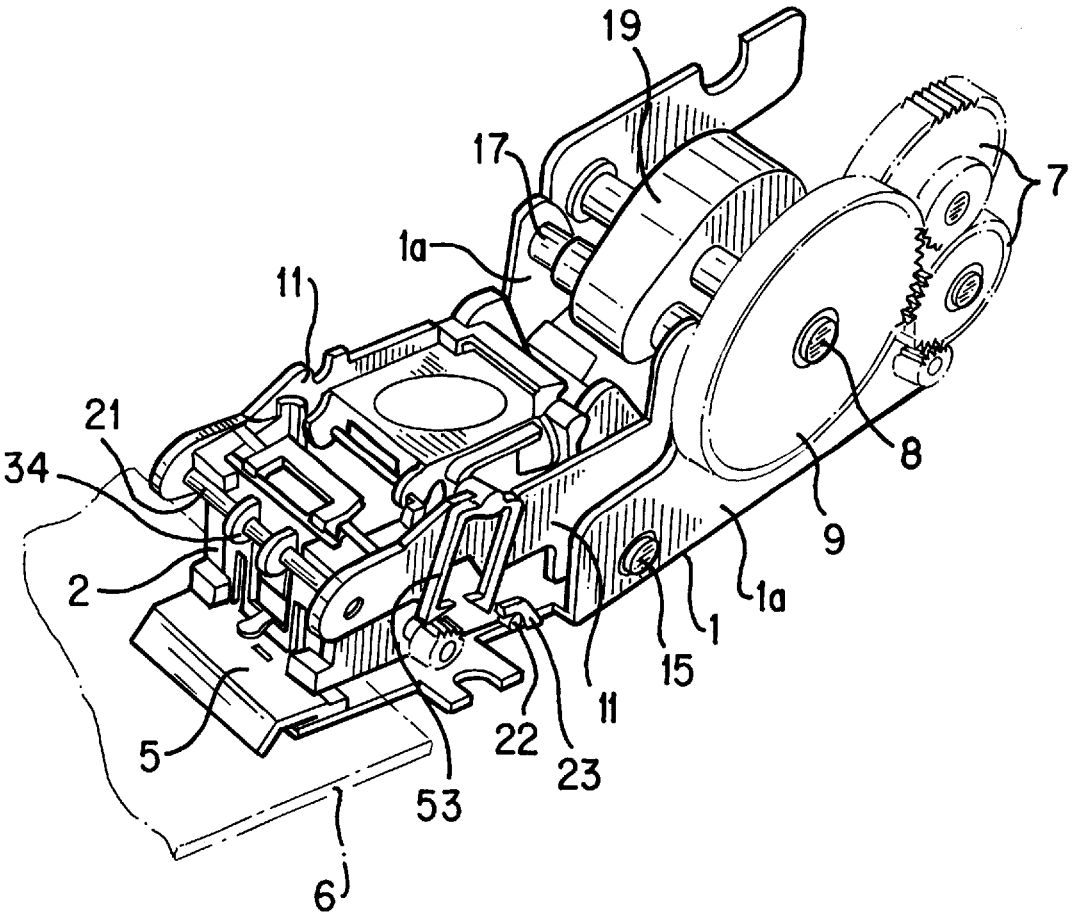
FIG. 1 is a perspective view of a motor driven stapler to which the present invention is applied.
Figure 2:
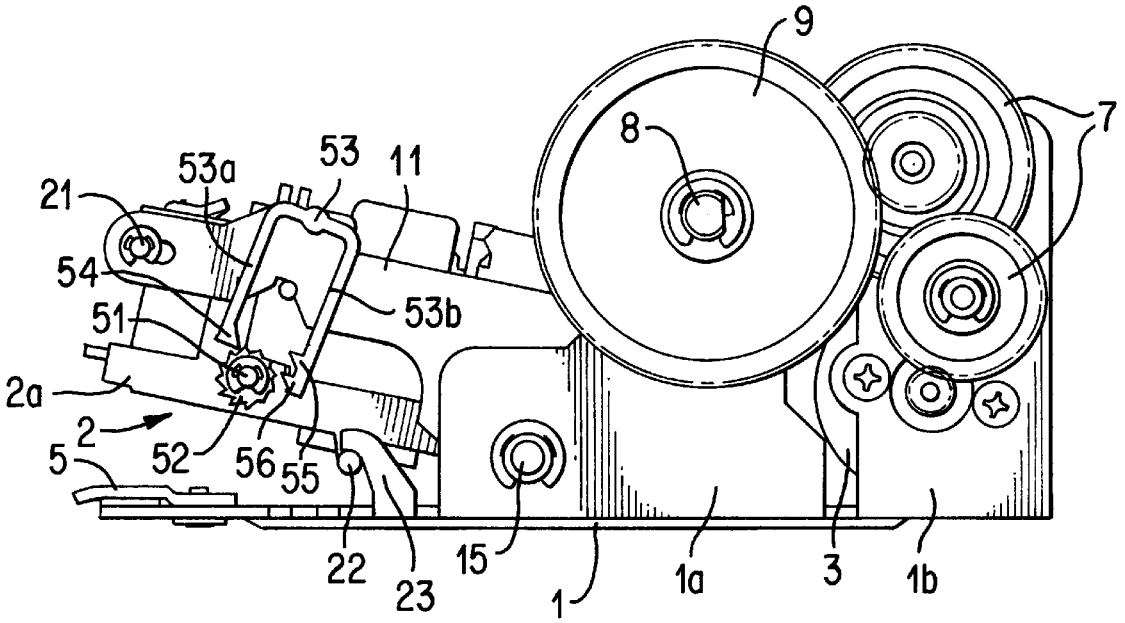
FIG. 2 is a side view of the motor driven stapler shown in FIG. 1.

FIG. 1 and FIG. 2 show a motor driven stapler to which the present invention is applied. The motor driven stapler is constructed in such a manner that a magazine 2 fitted with a staple cartridge 4 having a plurality of sheet-shaped staples, received therein in a multi-layered structure, is turnably arranged above a base frame 1 to turn about a support shaft 15 in an upward and downward direction, and when the magazine 2 is turned in the downward direction by rotationally driving an electric motor 3, a straight staple located at the foremost end of each sheet is removed from the staple cartridge 4 and formed by a forming plate 31 to exhibit a substantially inverted U-shaped contour and then struck by a driver 32 towards a stapling board 5 disposed at the fore end part of the base frame 1 so as to allow the feet of the substantially inverted U-shaped staple to penetrate through the papers 6 to be stapled together on the stapling board 5. In other words, the motor driven stapler comprises a magazine driving mechanism for turnably driving the magazine 2 to turn about the support shaft 15 in an upward and downward and direction, a staple forming and striking mechanism then forms each straight staple received in the magazine 2 by the forming plate 31 to exhibit a substantially inverted U-shaped contour and then striking the substantially inverted U-shaped staple by the driver 32 toward the stapling board 5, and a staple feeding mechanism for delivering each straight staple received in the magazine 2 to the staple forming/striking mechanism. The foregoing mechanisms will now be described in detail.

Figure 5:
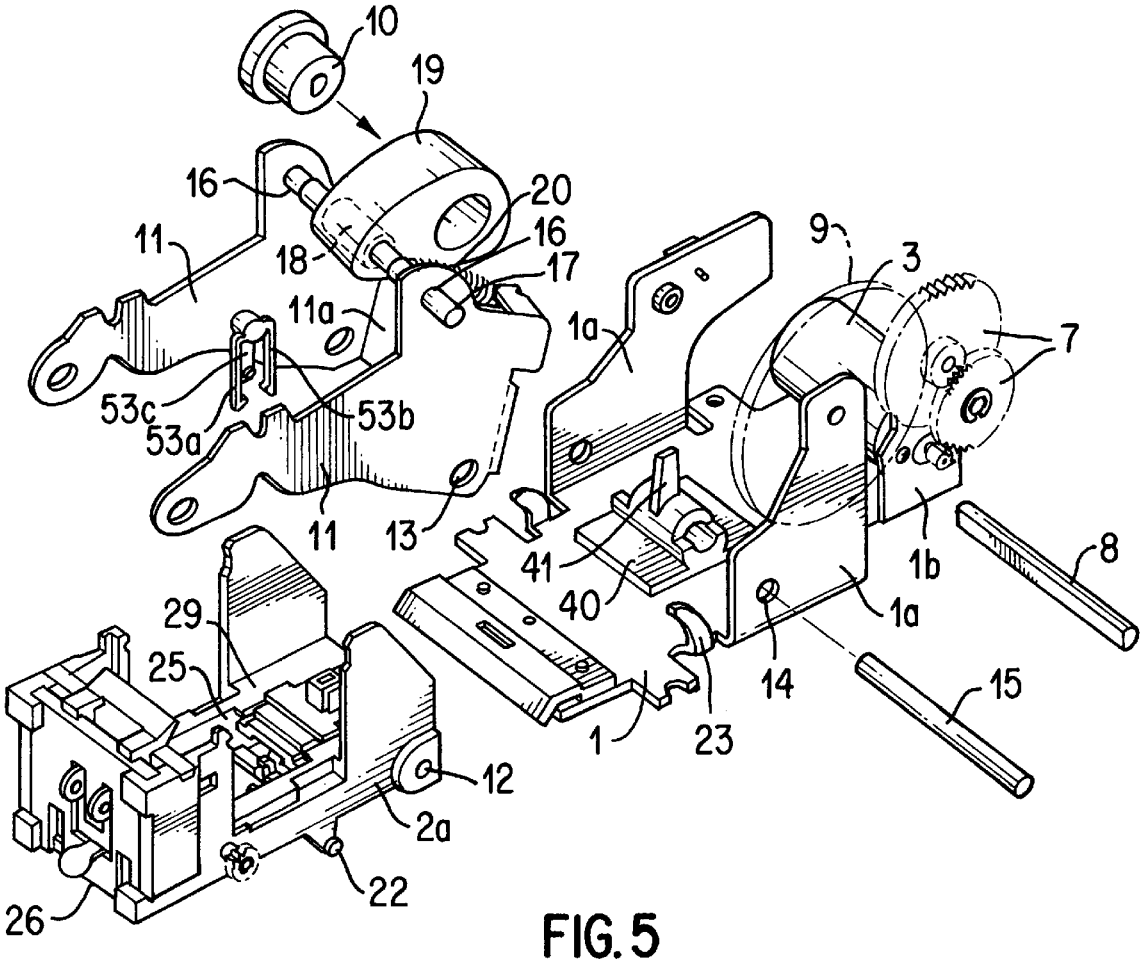
FIG. 5 is an exploded perspective view of a magazine, a pair of driving links and a base frame each of which is shown in the disassembled state.

First, the magazine driving mechanism for turnably driving the magazine 2 in the upward and downward directions will be described. As shown in FIG. 1, FIG. 2 and FIG. 5, a pair of upright standing pieces 1*a* are formed on the opposite sides of the base frame 1 at the central part of the latter and a single upright standing piece 1*b* is formed on the right-hand side of the base frame 1 at the rear part of the latter. An electric motor 3 and a plurality of intermediate gears 7, operatively connected to an output shaft of the electric motor 3, are arranged on the rear upright standing piece 1*b*. A driving shaft 8 is bridged between both the central upright standing pieces 1*a* so that a driving gear 9 fixedly mounted on the driving shaft 8 at the right-hand end of the latter meshes with the intermediate gears 7. An eccentric cam 10 fixedly mounted on the driving shaft 8, at the central part of the latter, is located at the intermediate position between the central upright standing pieces 1*a*. A magazine 2 and a pair of driving links 11 are arranged on the base frame 1 located on the opposite sides of the magazine 2. The support shaft 15 extends through shaft holes 12, at the rear lower end of the magazine 2, and shaft holes 13, at the rear lower ends of the driving links 11, so that the magazine 2 and the driving links 11 turn about the support shaft 15. Additionally, a roller shaft 17 extends through elongated holes 16 at the rear upper parts of the driving links 11 so that a cam roller 18 is rotatably supported on the roller shaft 17. As the eccentric cam 10 is rotated by the driving shaft 8, it is brought in lose contact with the cam roller 18. The eccentric cam 10 and the cam roller 18 are covered with a cam cover 19. Thus, the eccentric cam 10 operatively connected to the cam roller 18 via the cam cover 19. It should be noted that the roller shaft 17 is normally biased by the resilient power of a tension spring 20 so as to allow the roller shaft 17 to come in contact with the rear ends of the elongated holes 16.

Next, the foremost ends of the driving links 11 are connected to each other via a connecting shaft 21 transversely extending therebetween, and the connecting shaft 21 extends through projections 34 that project forward of the magazine 2 (see FIG. 1). Incidentally, the range of the turning movement of the magazine is defined between the position where the lower surface of the magazine 2, at the fore end of the latter, comes in contact with the stapling board 5 and the position where a pair of projections 22, projecting sideward of the magazine 2, are engaged with a pair of arc-shaped arms 23 standing upright from the base frame 1 on the opposite sides of the latter. A driver 32 is displaced in the upward or downward or direction relative to the magazine 2, and the working stroke of the driving links 11 is set to be larger than that of the magazine 2. The rear ends of the driving links 11 are connected to each other via a connecting wall 11*a* transversely extending therebetween (see FIG. 5).

Incidentally, it is not necessary that the driving links 11 are connected directly to the driver 32. For example, the driving links 11 may operatively be connected to a holding member (not shown) adapted to hold the driver 32.

Figure 3:
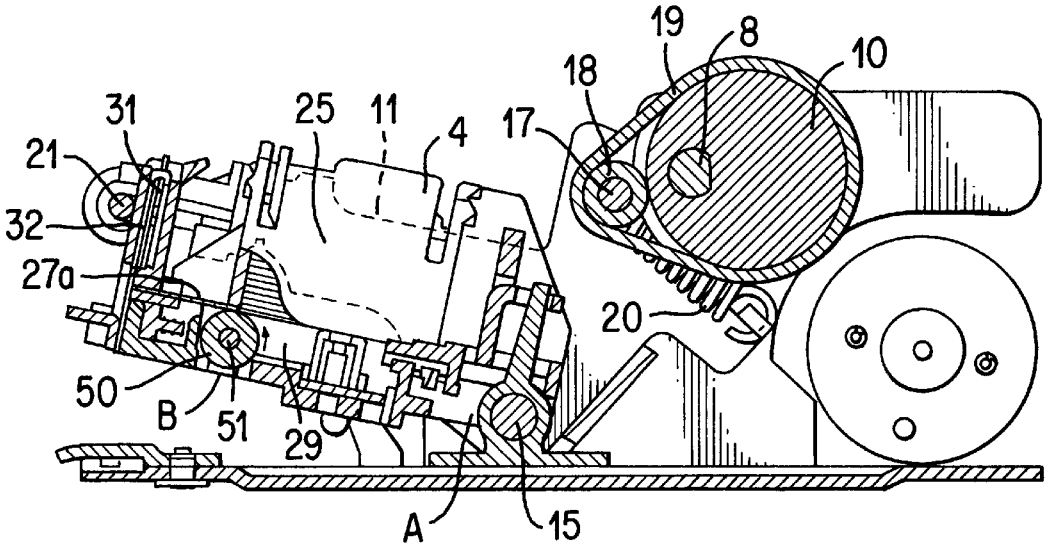
FIG. 3 is a partially cutaway side view of the motor driven stapler.
Figure 4:
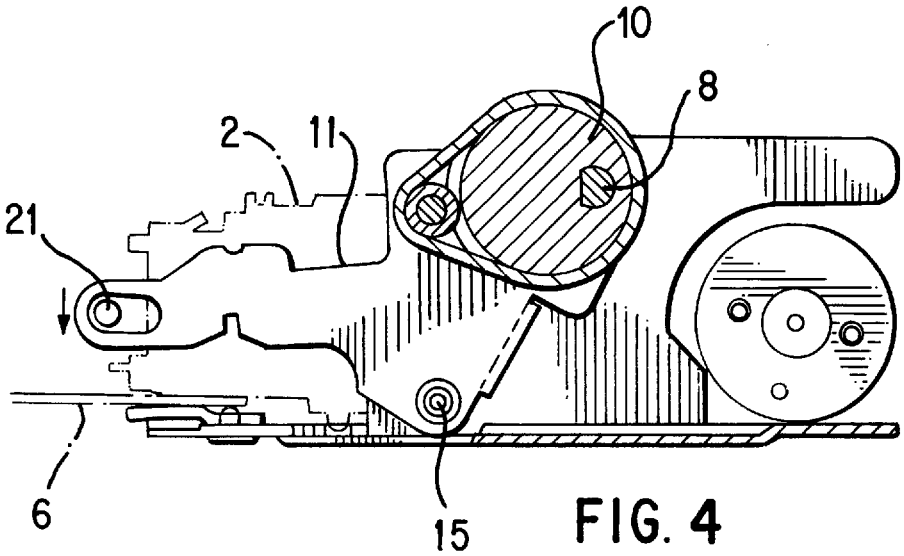
FIG. 4 is a schematic side view of the motor driven stapler, particularly showing a mode of operation of a mechanism for turnably driving a magazine.

As the electric motor 3 is rotationally driven, the driving gear 9 drives shaft 8 and the eccentric cam 10. As shown in FIG. 3 and FIG. 4, as the eccentric cam 10 is rotated, the outer peripheral surface of the eccentric cam 10 comes in close contact with the outer peripheral surface of the cam roller 18 and this causes the cam roller 18 to move away from the driving shaft 8. Thus, the magazine 2 turns about the support shaft 15 in the downward direction. On the contrary, as the outer peripheral surface of the eccentric cam 10 is displaced away from the outer peripheral surface of the cam roller 18 to vary from the; state shown in FIG. 3 to that shown in FIG. 4, the cam roller 18 is pulled by the cam cover 19 to the driving shaft 8 and the magazine 2 turns about the support shaft 15 in the upward direction. Thus, the driving links 11 can be returned together with the magazine 2 without fail.

Since the driving links 11 are reciprocally turnably displaced to turn about the support shaft 15 in the above-described manner, the foremost end of the magazine 2, operatively connected to the foremost ends of the driving links 11, is turnably driven to turn about the support shaft 15 in the upward and downward directions. Since the turnable driving of the driving links 11 is achieved with the aid of the simple structure comprising the eccentric cam 10, the cam roller 18 and the cam cover 19, the whole structure of the magazine driving mechanism can be designed with small dimensions. Additionally, since the eccentric cam 10 and the cam roller 18 are arranged one after another along the center line of the driving links 11, the driving links 11 are always driven in synchronization with the magazine 2. Further, since return of the driving links 11 is achieved with the aid of the cam cover 19, it is not necessary that the resilient power of spring means be taken into account. This is in contrast with cases where the turnable displacement of the driving links 11 in the rearward direction is achieved with the aid of spring means. Thus, stable return of the driving links 11 can be realized with the aforementioned structure without fail.

However, any type of driving mechanism, e.g., a driving mechanism including a grooved cam may be employed in place of the aforementioned driving mechanism, provided that an output from the electric motor 3 can be converted into reciprocable turning movement of the driving links 11 about the support shaft 15.

Figure 7:
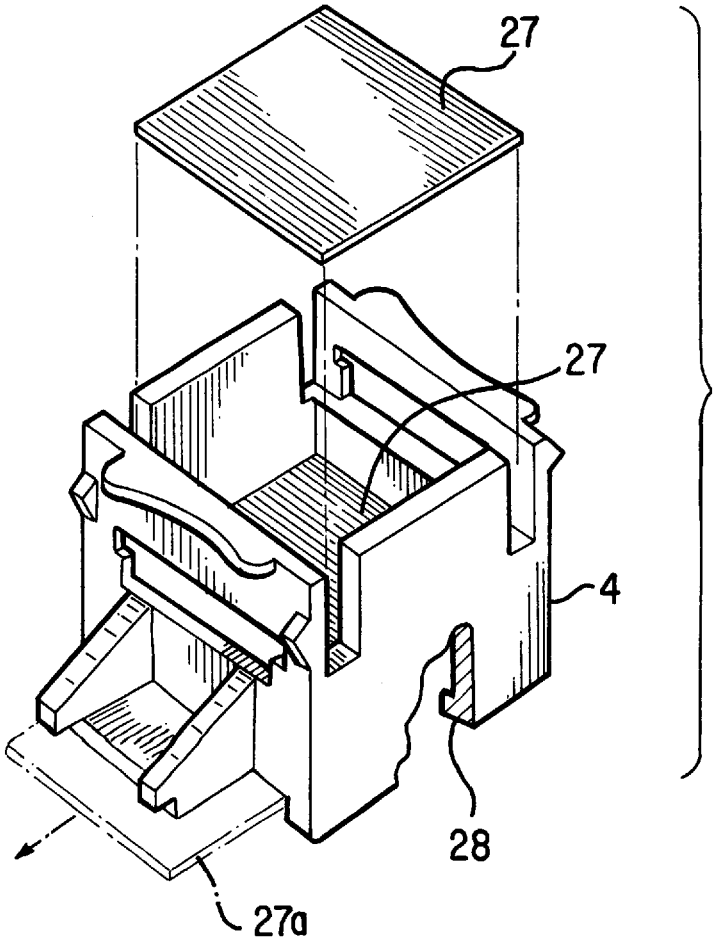
FIG. 7 is a perspective view of a staple cartridge.
Figure 12:
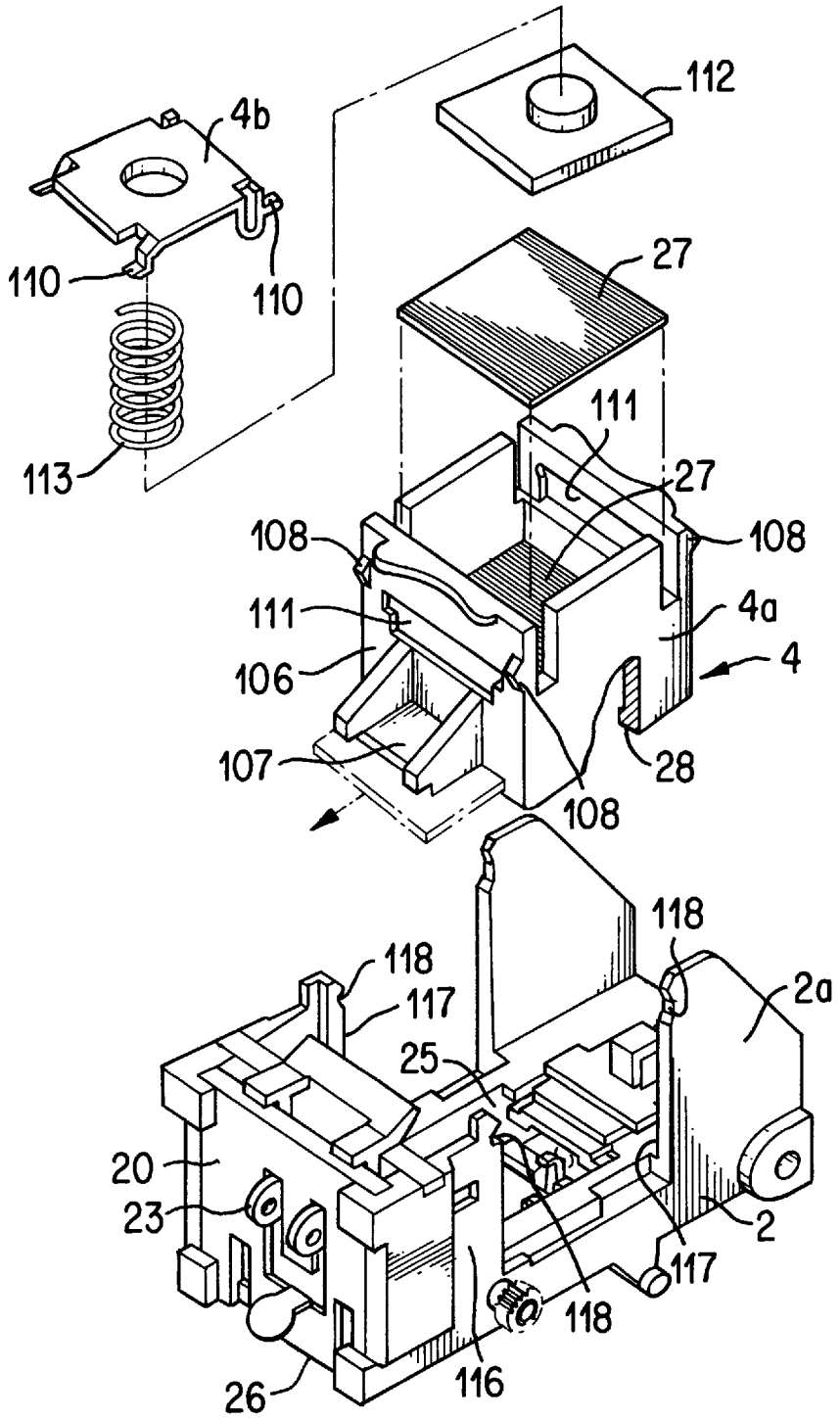
FIG. 12 is an exploded perspective view of a magazine and a staple cartridge, showing essential components constituting the magazine and the staple cartridge in the disassembled state.

Next, the structure of the magazine 2 and a staple forming or striking mechanism, for forming each straight staple by a forming plate 31 to exhibit a substantially inverted U-shaped contour and then striking a substantially inverted U-shaped staple by the driver 32, will be described below with reference to FIG. 5 to FIG. 7. As shown in the drawings, a staple cartridge fitting section 25 formed at the central part of a magazine housing 2*a* of the magazine 2 so as to allow a staple cartridge 4 to be fitted thereinto, and a staple forming/striking section 26 is formed on the downstream side of the staple cartridge fitting section 25. The rear end of the magazine housing 2*a* is turnably supported to turn about the support shaft 15 which transversely extends through the central upright standing pieces 1*a* on the base frame As shown in FIG. 7, a plurality of sheet-shaped staples 27 are received in the staple cartridge 4 in the multi-layered structure, and a pair of inwardly projected support projections 28 are formed along the lower ends of the side walls for holding the lower surface of the lowermost sheet-shaped staple 27*a*. The bottom of the staple cartridge 4 and the lower ends of both the side walls of the same are kept opened. A pair of inwardly projected guide walls 29 are formed on the inner wall surfaces of both the side walls of the magazine housing 2*a* for holding the lower surface of each sheet-shaped staple 27*a* taken out away from an opening portion formed at the lower end of a fore wall of the staple cartridge 4. As is best seen in FIG. 3, the bottom of the staple cartridge fitting section 25 is kept opened, and a staple feeding mechanism for feeding the lowermost sheet-shaped staple 27*a* among plurality of sheet-shaped staples 27 received in the staple cartridge 4 in the forward direction with the aid of the guide projections 29 is arranged below the bottom of the staple cartridge fitting section 25. As shown in FIG. 12, a cap 4*b* is placed on the upper end of the staple cartridge 4, and a coil spring disposed between the cap 4*b* and the uppermost sheet-shaped staple 27 so as to normally depress the laminated sheet-shaped staples 27 in the downward direction.

As shown in FIG. 12, the staple cartridge 4 is composed of a cartridge housing 4*a* that has a plurality of sheet-shaped staples 27 received therein in the laminated state and a cap 4*b* placed on the cartridge housing 4*a*. An outfeed guide 107 is projected outward of a fore wall 106 of the cartridge housing 4*a* for successively delivering the sheet-shaped staples 27 via the outfeed guide 107, and four engagement projections 108 are formed on the opposite sides of the fore wall as well as the rear wall of the cartridge housing 4*a*. A pair of inwardly projecting edges 28 are formed along the lower ends of both the side walls for holding the lower surface of the lowermost sheet-shaped staple 27 along the opposite side edges of the latter. The bottom of the cartridge housing 4*a* is kept opened with the exception of both the inwardly projected edges 28. An engagement piece 110 is formed at each corner of the cap 4*b*, and the engagement pieces 110 are brought in engagement with opening portions 111 formed through both the fore and rear walls of the cartridge housing 4*a*. A depressing plate 112 and a coil spring 113 are arranged between the cap 4*b* and the uppermost sheet-shaped staple 27 so that the laminated sheet-shaped staples 27 are normally forced in the downward direction by the resilient force of the coil spring 113.

Referring to FIG. 12 again, a staple cartridge fitting section 25 is formed at the central part of the magazine 2, and a staple forming and striking section 26 is formed ahead of the staple cartridge fitting section 25. A staple feeding unit (not shown) for feeding each staple 27 received in the staple cartridge 4 to the forming and striking section 26, is arranged below the cartridge fitting section 25. The magazine 2 is dimensioned to have the same width, as measured in the transverse direction, as that of the staple cartridge 4. Side walls 2*a* stand upright on the opposite sides of the cartridge 4 while extending in parallel with each other, and substantially U-shaped cutouts 117, each kept opened in the upward direction, are formed at the central parts of both the side walls 2*a* corresponding to the geometrical configuration of the staple cartridge fitting section 25. In addition, recessed engagement portions 118, are adapted to receive the engagement projections 108 on the staple cartridge 4 and are formed at the upper open ends of the cutouts 117 on both the fore and rear sides of the latter.

Figure 13:
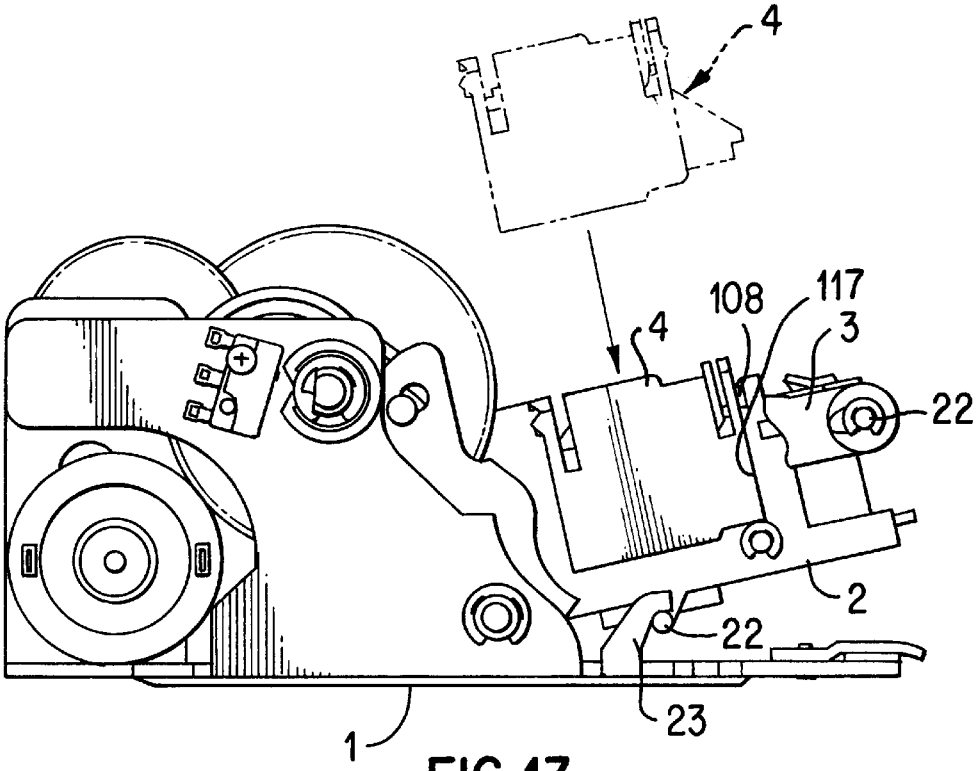
FIG. 13 is a fragmentary side view of the motor driven stapler to which the present invention is applied.

When the staple cartridge 4 is fitted into the staple cartridge fitting section 25 of the magazine 2, as shown in FIG. 13, the staple cartridge 4 is first fitted into the cutouts 117. The engagement projections 108, on the cartridge housing 4*a*,are then brought in engagement with the recessed engagement portions 118 on the side walls 2*a*.

With the mechanism constructed in the above-described manner, the turning movement of the magazine is stopped especially in the course of the turning movement of the same in the upward direction from below. At this time, the driver plate is actuated relative to the magazine in the upward direction. For example, when the magazine is clogged with a staple due to incorrect stapling, there typically arises a malfunction such that the driver plate cannot be actuated in the magazine, and in an extreme case, the driver plate is integrally seized by the magazine. Since the magazine is forcibly raised up together with the driver plate in this case, a large force is exerted on the magazine, and stress is concentrated along the cutouts on the side walls of the cartridge. However, since the staple cartridge is fitted into the staple cartridge is fitting section and is additionally fitted into the cutouts on the side walls, a part of the load effective for bending the magazine can be borne by the staple cartridge. Consequently, malfunctions that affect the rigidity of the magazine do not arise, and moreover, the magazine is no longer bent or broken when an excessively high intensity of force is applied to the magazine.

In addition, according to the present invention, a part of the magazine is cut out so that the foregoing part is utilized as a part of the staple cartridge fitting section, whereby the whole structure of the mechanism can be designed with small dimensions.

Figure 6:
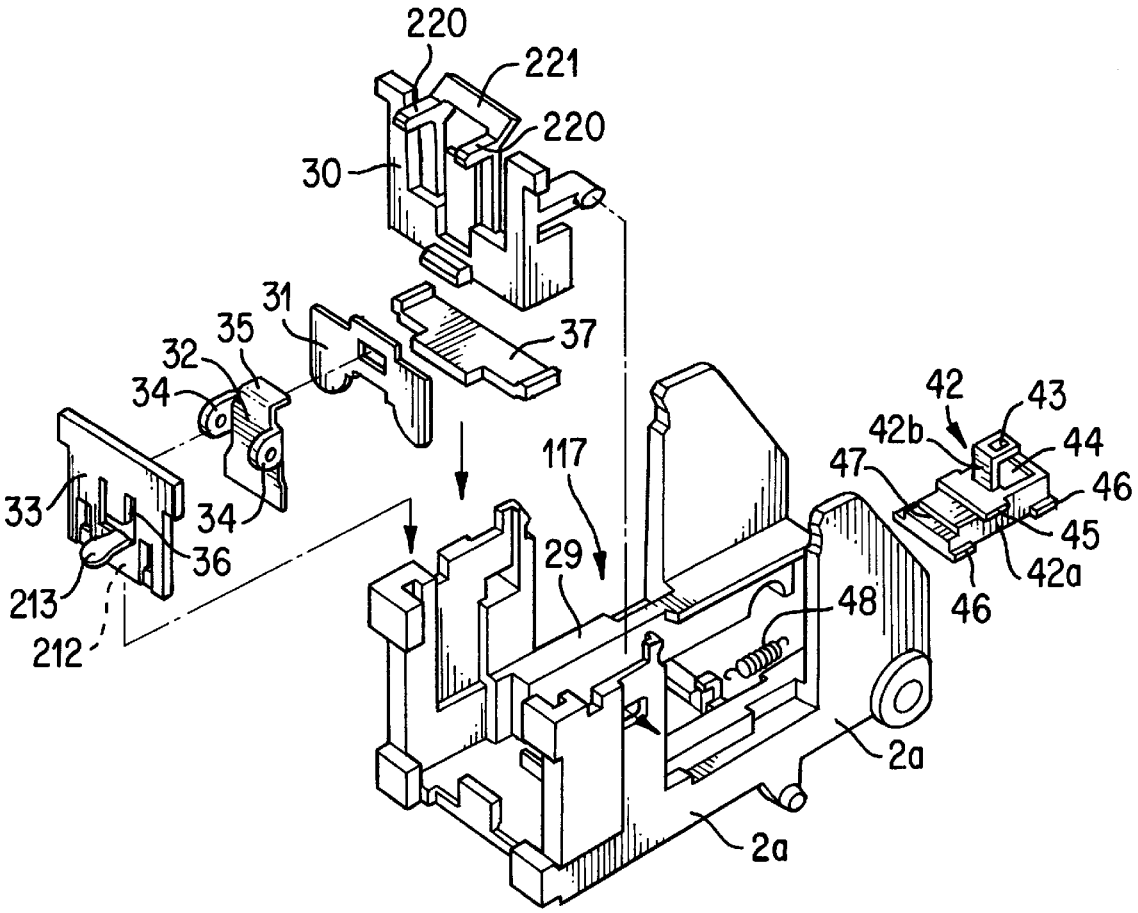
FIG. 6 is an exploded perspective view of a magazine which is shown in the disassembled state.

As shown in FIG. 6, a guide plate 30 is fixedly secured to the foremost end of the magazine 2, and a face plate 33 is disposed on the downstream side of the guide plate 30 while the forming plate 31 and the driver 32 are interposed between the guide plate 30 and the face plate 33.

The face plate 33 is disposed at the foremost end of the magazine 2 to slidably move in upward and downward directions, while the driver 32 is disposed behind the face plate 33 to slidably move along the rear surface of the face plate 33 in upward and downward directions. A staple receiving portion 212 is formed at the lower part of the rear surface of the face plate 33 for receiving a substantially inverted U-shaped staple, and a projection 213 for raising up the face plate with users fingers is formed on the front side of the face plate 33. In addition, a pair of slit-shaped opening portions 36, each having a considerably large length as seen in the vertical direction, are formed through the face plate 33.

Figure 8:
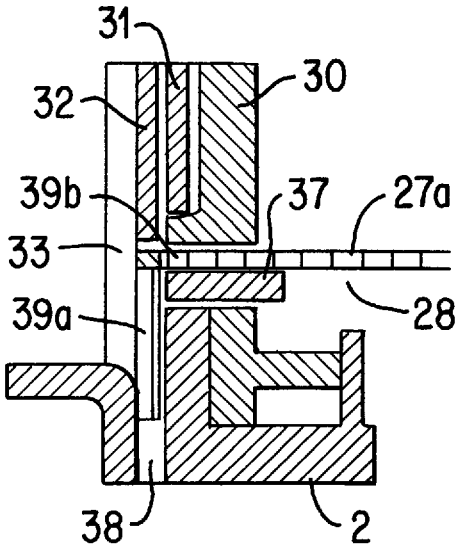
FIG. 8 is a fragmentary enlarged sectional view of a forming/striking section formed on the magazine.

A pair of projection pieces 34 each extend in the forward direction and are formed by bending a part of the driver 32, while a projection piece 35 extending in the rearward direction is formed by likewise bending a part of the driver 32. When rear projection place 35 passes through an opening portion on the forming plate 31, the fore projection pieces 34 pass through the opening portions 36 on the face plate 33 to project forward of the face-plate 33. As shown in FIG. 1, a connecting shaft 21 extends through the fore projection pieces 34 at a right angle relative to the magazine 2 and serves as connecting means for connecting the foremost ends of the driving links 11 to the magazine 2. Thus, the foremost end of the magazine 2 is operatively connected to the driving links 11 via the connecting shaft 21. As shown in FIG. 8, an anvil 37 is disposed below the forming plate 31, and a certain gap for enabling the driver 32 to slidably move therethrough in the downward direction is formed between the anvil 37 and the face plate 33. Thus, a staple 27 delivered in the forward direction with the aid of the staple feeding mechanism is caused to intermittently move between the forming plate 31 and the anvil 37.

Figure 14A:
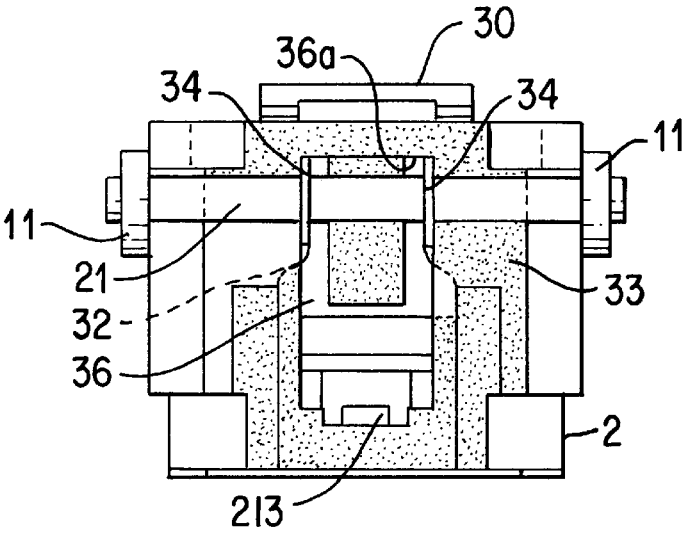
FIG. 14(*a*) and FIG. 14(*b*) show the motor driven stapler and a mode of operation of the same.
Figure 14B:
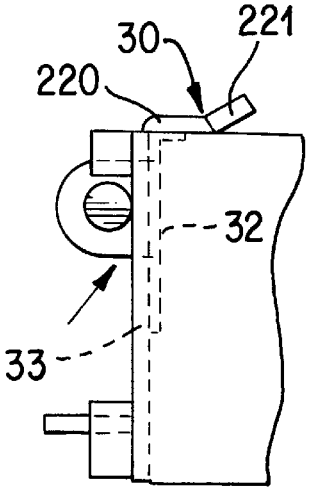

As shown in FIG. 14(*b*), a pair of retaining portions 220 are adapted to be engaged with the upper end of the face plate 33 and to retain the latter which are formed at the upper end of the guide plate 30 while extending forward of the latter. A retaining piece 221, for releasing the face plate 33 from the retained state, is likewise formed at the upper end of the face plate 33 while extending rearward of the latter. As is best seen in FIG. 2, the retaining portions 220 and the retaining piece 221 are integrated with each other. As shown in FIG. 14 (*b*), the retaining portion 220 is turnable in the arrow-marked direction by depressing the retaining piece 221 with a user's finger so that it is displaced away from the uppermost end of the face plate 33.

While the face plate 33 is held in the closed state, i. e., the foremost end of the magazine 2 is closed with the face plate 33. The projection pieces 34 of the driver 32 are connected by the connecting shaft 21 to the foremost ends of the driving links 11 and are brought in contact with upper edges 36*a* of the opening portions 36 (see FIG. 14(*a*)). On the contrary, when the face plate 33 is raised up to reach the uppermost end thereof, the projection pieces 34 of the driver 32 are brought in contact with lower edges 36*b* of the opening portions 36 of the face plate 33 (see FIG. 15(*a*)).

Figure 9A:
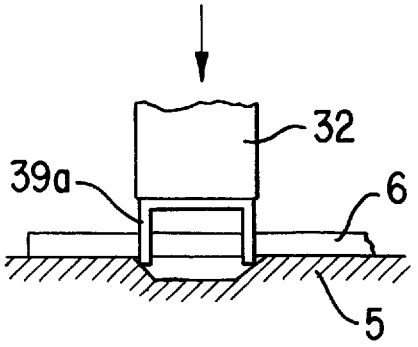
FIG. 9(*a*) is a fragmentary illustrative view which shows that a substantially inverted U-shaped staple is struck by a driver in a forming/striking section, and FIG. 9(*b*) is a fragmentary illustrative view which shows that a straight staple is bent by a forming plate in the forming/striking section to exhibit a substantially inverted U-shaped contour.
Figure 9B:
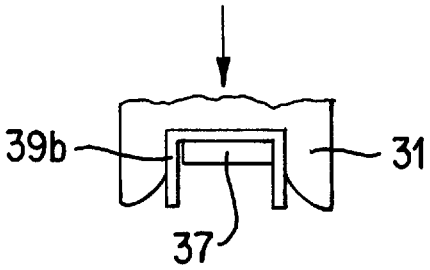
Figure 10A:
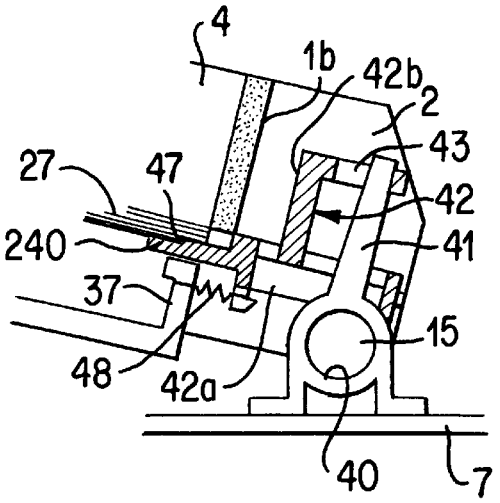
FIG. 10(*a*), FIG. 10(*b*), FIG. 10(*c*) and FIG. 10(*d*) show a mode of operation of a staple feeding apparatus constructed according to the present invention.
Figure 10B:
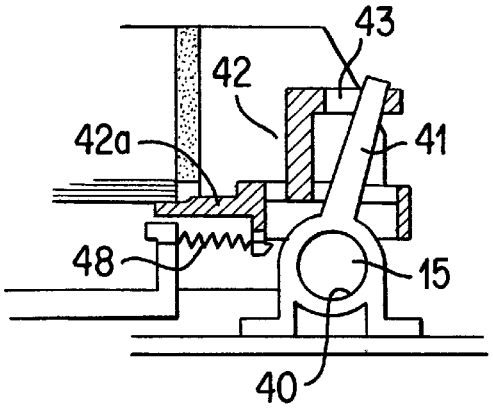
Figure 10C:
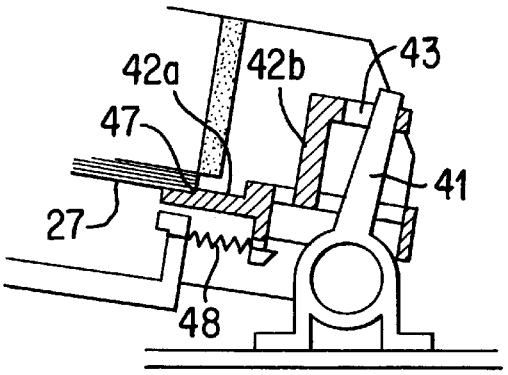
Figure 10D:
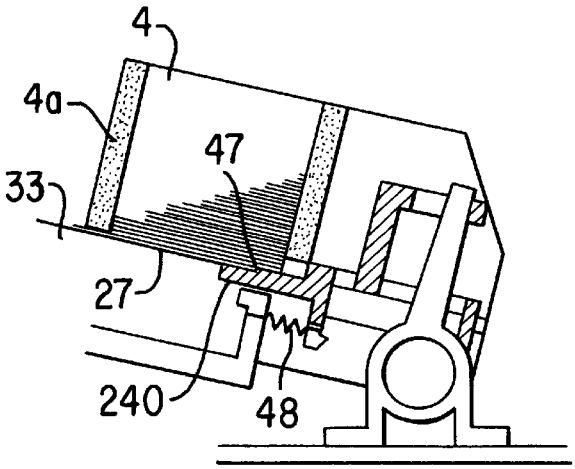
Figure 11A:
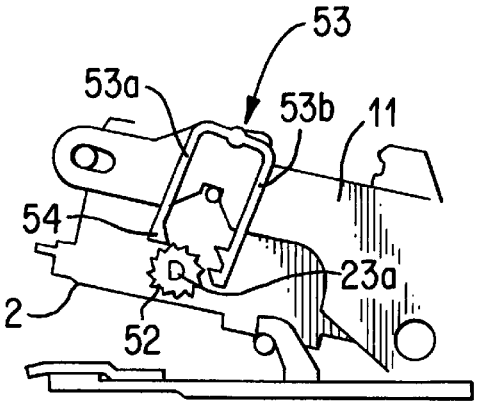
FIG. 11(*a*), FIG. 11(*b*), FIG. 11(*c*) and FIG. 11(*d*) show a mode of operation of a staple feeding mechanism constructed according to the present invention.
Figure 11B:
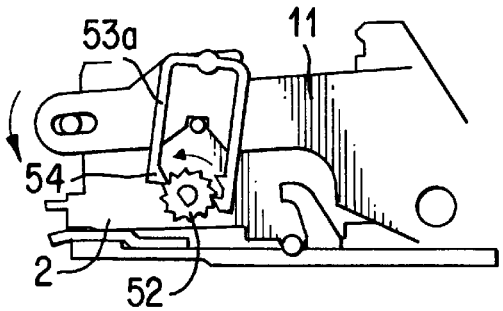
Figure 11C:
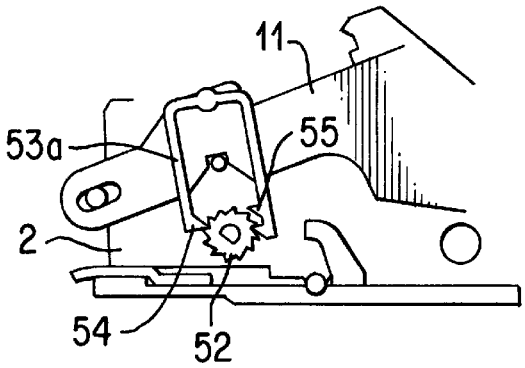
Figure 11D:
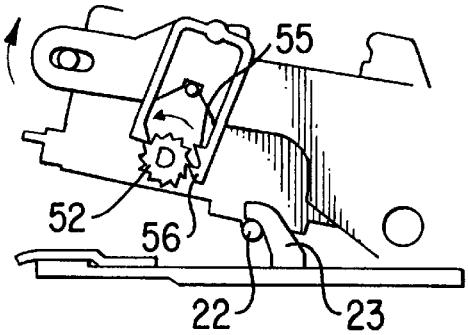

As the driving links 11 are driven in an upward and downward direction with this construction, the driver 32 is displaced in an upward and downward direction. At this time, the magazine 2 is turned in the upward or downward direction in the presence of the frictional resistance arising from the magazine 2 and the driving links 11. As shown in FIG. 4, when the magazine 2 is turned in the downward direction as the driver 32 is displaced in the downward direction the magazine 2 is stopped because the lower surface of the magazine at the fore end part of the same comes in contact with the upper surface of papers 6 to be stapled together on the stapling boards 5. However, since the driving links 11 and the driver 32 can be displaced further in the downward direction, a staple 39*a* (formed to exhibit a substantially inverted U-shaped contour) is delivered to the staple receiving portion 38 positionally coincident with the rear surface of the face plate 33. The staple 39*a* is then struck toward the stapling board 5 by the driver 32 as shown in FIG. 8, and the feet of the staple 39*a* are forced through papers 6 which are on the stapling board 5 as shown in FIG. 9(*a*). At this time, the forming plate 31 is driven together with the driver 32 in the downward direction so that the opposite sides of a straight staple 39*b* placed on the anvil 37 are depressed by the forming plate 31 to exhibit a substantially inverted U-shaped contour as shown in FIG. 9(*b*). Subsequently, when the driver 32 is displaced in the upward direction, the staple 39*a* formed to exhibit a substantially inverted U-shaped contour is delivered to the rear surface of the face plate 33, and at the same time, another straight staple 39*b* is delivered to the position located on the anvil 37. A series of straight staples of each sheet-shaped staple 27*a* are successively formed by the forming plate 31 and then struck by the driver 32.

Figure 15A:
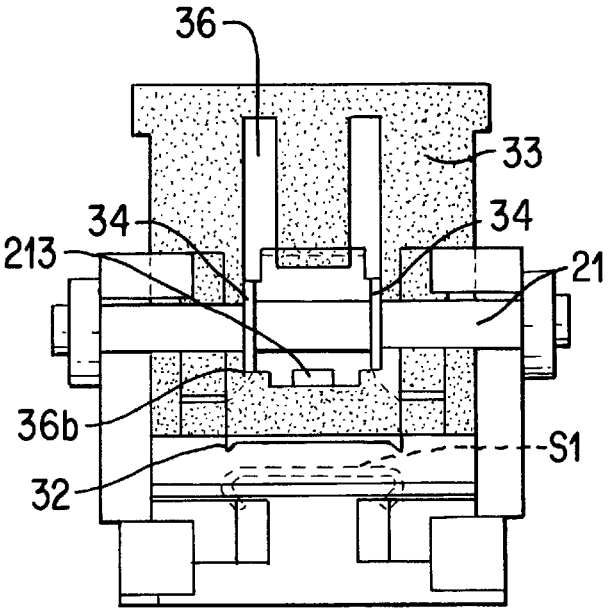
FIG. 15(*a*) is an enlarged front view of the magazine, showing that the face plate is raised and FIG. 15(*b*) is a fragmentary side view of the magazine shown in FIG. 15(*a*).
Figure 15B:
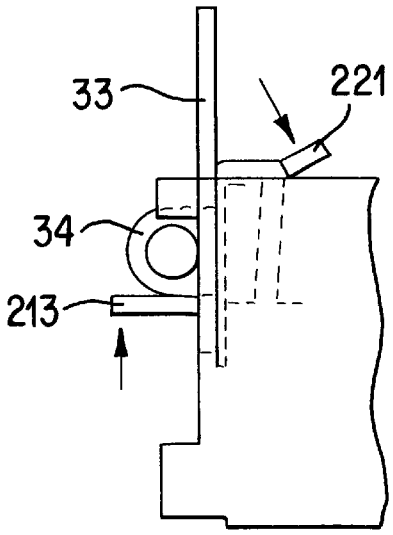
Figure 16A:
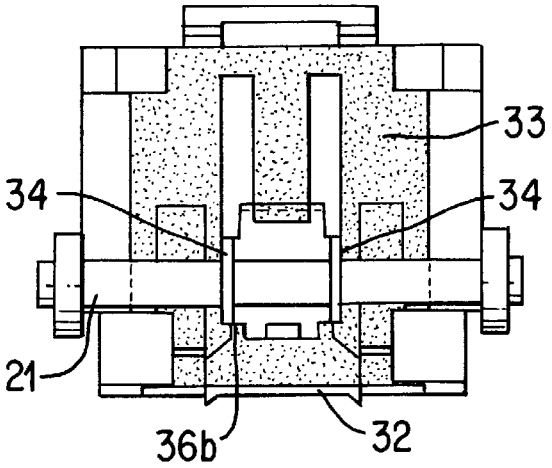
FIG. 16(*a*) is an enlarged front view of the magazine, particularly showing that the face plate is forcibly displaced in the downward direction, and FIG. 16(*b*) is a fragmentary side view of the magazine shown in FIG. 16(*a*).
Figure 16B:
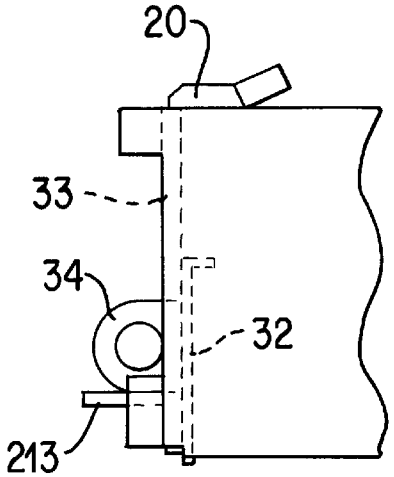

After the retaining piece 221 on the guide plate 30 is depressed with a users finger to release the face plate 33 from the engaged state, the face plate 33 is displaced away from the normal state as shown in FIG. 14(*a*) and FIG. 14(*b*) in the upward direction by actuating the projection 213 forward of the face plate 33 with the user's fingers until the elevated state of the face plate 33 as shown in FIG. 15(*a*) and FIG. 15(*b*) is assumed. Once the face plate 33 is completely displaced in the upward direction, the foremost end of the magazine 2 is kept opened. Thus, when the magazine 2 is clogged with a staple S1 during a stapling operation, the clogged staple S1 can be removed from the magazine 2 through the opened foremost end of the latter. Since the projection pieces 34 of the driver 32 are brought in contact with the lower edges 36*b* of the opening portions 36 on the face plate 33, malfunction arises since the face plate 33 is horizontally disconnected away from the magazine 2.

After the clogged staple S1 is removed from the magazine 2 through the opened foremost end of the latter, the face plate 33 is forcibly displaced with user's fingers in the downward direction to close the foremost end of the magazine 2 with the face plate 33. If a stapling operation is started while the face plate 33 is kept opened because a user forgets the connecting shaft 21 serves to displace the driver 32 together with the projection pieces 34 in the downward direction at the same time when the driving links 11 are turnably displaced in the downward direction. The projection pieces 34 of the driver 32 then come in contact with the lower edges 36*b* of the opening portions 36 on the face plate 33 to depress the face plate 33 therewith. Thus, the face plate 33 is slidably displaced in the downward direction, and when the driving links 11 reach the lower dead points, the face plate 33 reaches the lowermost end thereof. At this time, the retaining portions 220 on the guide plate 30 are brought in engagement with the uppermost end of the face plate 33 while preventing the face plate 33 from being displaced in the upward direction.

With the mechanism constructed in the above-described manner, when the magazine is clogged with a staple during a stapling operation, the face plate is raised up with users fingers so to allow the foremost end of the magazine to be kept opened. Thus, the staple clogged in the magazine during the stapling operation can be removed from the magazine through the opened foremost end of the latter. Subsequently, when the driving links are turnably displaced in the downward direction after the clogged staple is removed from the magazine, the projection pieces of the driver are brought in contact with the lower edges of the opening portions on the face plate, and at the same time, the face plate is displaced in the downward direction to reach the lowermost end thereof so that the foremost end of the magazine is closed with the face plate. Therefore, even in the case where a stapling operation is performed after the clogged staple is removed from the magazine while the foremost end of the magazine is kept closed for the reason that a user forgets to close it with the face plate, the foremost end of the magazine is automatically closed with the face plate by the connecting shaft extending through the projection pieces of the driver at a right angle relative to the magazine. Thus a malfunction does not arise when the driver is undesirably deformed or the magazine is held in the locked state.

In addition, according to the present invention, since there is no need of additionally arranging a special unit such as an interlock switch or the like for the motor driven stapler, the whole structure can be designed with small dimensions.

Next, the staple feeding mechanism for feeding from the staple cartridge 4 each sheet-shaped staple 27*a* is composed of a first feeding unit A arranged at the rear part of the staple cartridge 4 and a second feeding unit B arranged on the downstream side of the first feeding unit A.

The first feeding unit A serves to thrust the rear end of the lowermost sheet-shaped staple 27*a* among a plurality of sheet-shaped staples 27 received in the staple cartridge 4 so as to allow it to be taken out away from a fore wall of the staple cartridge 4 when the magazine 2 is turnably driven in the upward direction. It is composed of a support rod 41 (see FIG. 5) slantwise standing upright from a bearing portion 40 for the support shaft 15 disposed at the central part of the base frame 1 and a feeding member 42 (see FIG. 6) disposed to slidably move on the magazine 2 in the forward and rearward directions. An inverted L-shaped piece 42*b* is formed above a plate portion 42*a* of the feeding member 42, and an opening portion 43 is formed through the upper end part of the inverted L-shaped piece 42*b*, while an opening portion 44 is formed through the plate portion 42*a* of the feeding member 42. The support rod 41 is inserted through both the opening portions 43 and 44. Upper projections 45 and lower projections 46 are projected sideward of the opposite sides of the plate portion 42*a*, and each projected guide wall 29 is inserted between the upper projection 45 and the lower projections 46 as seen in the direction of extension of the projected guide wall 29. The plate portion 42*a* of the feeding member 42 is operatively engaged with the projected guide walls 29 to slidably move along the projected guide walls 29 in the direction of feeding of each sheet-shaped staple 27*a*. With such construction, the feeding member 42 is always inclined at the same angle as that of the magazine 2, and it is held to slidably move in the direction of feeding of each sheet-shaped staple 27*a*. In addition, a contact portion 47 is formed on the upper surface of the plate portion 42*a* in the shape of a stepped wall having thickness equal to that of a single sheet-shaped staple 27*a*. The feeding member 42 is normally biased by the resilient power of a tension spring 48 to move in the forward direction.

With the first feeding unit A constructed in the above described manner, the foremost end to the magazine 2 is raised up to assume the upper position as shown in FIG. 10(*a*) and the feeding member 42 is inclined at the same inclination angle as that of the magazine 2. The foremost end of the feeding member 42 is then taken in the staple cartridge 4 farthest away from the inner wall surface of the staple cartridge 4. When the magazine 2 is turned in the downward direction while the foregoing state is maintained, the feeding member 42 is forcibly turned in the downward direction as shown in FIG. 10(*b*) until the opening portion 43, formed through the upper end part of the inverted L-shaped piece 42*b*, is brought in engagement with the support rod 41. Subsequently, the feeding member 42 is turned with the foregoing engagement portion as a center for the turning movement of the feeding member 42. Since the center for the turning movement of the magazine (positionally coincident with the support shaft 15) is positionally offset from the center for the turning movement of the feeding member 42 in the above-described manner, the feeding member 42 is relatively displaced in the rearward direction in such a manner as to move back from the magazine 2 by a distance equal to the extent of the turning movement of the magazine 2, causing the tension spring 48 to be expanded. When the magazine 2 is turned in the upward direction again so that the foremost end of the magazine 2 is raised up to assume the upper position, the inverted L-shaped piece 42*b* of the feeding member 42 is released from the engaged state caused by the engagement of the opening portion 43 of the inverted L- shaped piece 42*b* with the support rod 41. The feeding member 42 is then is placed in the forward direction, relative to the magazine 2, by the resilient power of the tension spring 48. Thus, as shown in FIG. 10(*c*), the contact portion 47 on the plate portion 42*a* is brought in contact with the rear end of the lowermost sheet-shaped staple 27*a* among a plurality of sheet-shaped staples 27 received in the staple cartridge 4 in the course of the forward displacement of the feeding member 42 so that the lowermost sheet-shaped staple 27*a* is displaced in the forward direction. As the lowermost sheet-shaped staple 27*a* is increasingly displaced in the forward direction, it is taken out through an opening portion formed through the fore wall of the staple cartridge 4 at the lower end of the latter by a distance equal to that of the contact portion 47 taken inside of the staple cartridge 4 as shown in FIG. 10(*d*).

It should be noted that while each sheet-shaped staple 27 is increasingly taken out in the above-described manner, the upper surface of a fore part 240 of the feeding member 42 extending ahead of the contact portion 47 of the plate portion 42*a* serves to hold the lower surface of the sheet-shaped staple 27 while preventing the latter from being excessively bent.

With the staple feeding apparatus constructed in the above-described manner, each sheet-shaped staple 27 is forced in the forward direction by the resilient force of the tension spring 48 exerted on the rear end of the sheet-shaped staple 27. At this time, the force given by the tension spring 48 is sufficiently larger than the frictional resistance present between the lower surface of the sheet-shaped staple 27 and the feeding member 42. Thus, even in case that the lowermost staple 27 partially adheres to a subsequent staple located above the foregoing one or partial entanglement occurs between them, there does not arise a malfunction such that the lowermost sheet-shaped staple 27 fails to be taken out away from the staple cartridge 4 due to shortage of the force. Consequently, a plurality of sheet-shaped staples 27 received in the staple cartridge 4 can successively be taken out away from the staple cartridge 4 without fail regardless of the frictional resistance present between the lower surface of each sheet-shaped staple 27 and the feeding member 42 by repeating the aforementioned steps.

As shown in FIG. 2 and FIG. 3, the second feeding unit B is composed of a feeding roller 50 disposed directly below the opened bottom of the magazine housing 2*a*, a ratchet 52 fixedly mounted on a roller shaft 51 at the right-hand end of the latter and located outside of the fore wall of the magazine housing 2*a*, and an inverted U-shaped ratchet lever 53 turnably disposed above the ratchet 52.

Incidentally, it is not necessary that the ratchet 52 is fixed directly to the feeding roller shaft 51 at the right-hand end of the latter. Alternatively, the ratchet 52 may be fixed to another shaft which is operatively connected to the feeding roller 50.

The ratchet lever 53 is molded of an elastic material such as a synthetic resin or the like to exhibit an inverted U-shaped contour and comprises a fore lever portion 53*a*, a rear lever portion 53*b* and an inverted L-shaped piece 53*c* projected sideward of the uppermost end thereof (see FIG. 5). The inverted L-shaped piece 53*c* is fixedly secured to one of the driving links 11. A single pushing pawl 54 is formed at the foremost end of the fore lever portion 53*a*, while two pulling pawls 55 and 56 are formed at the foremost end of the rear lever portion 53*b*. A gap between the pushing pawl 54 and the pulling pawls 55 and 56 is set to be smaller than an outer diameter of the ratchet 52. When the driving links 11 are raised up to assume the upper position relative to the magazine 2, the pushing pawl 54 and the pulling pawl 55 and 56 are located above the ratchet 52. In contrast, when the driving links 11 are displaced in the downward direction to assume the lower position relative to the magazine 2, they are brought in engagement with the ratchet 52.

With the second feeding unit B constructed in the above-described manner, when the driving links 11 are turnably driven in the downward direction, causing the magazine 2 to be turned in the downward direction as shown in FIG. 11(*a*) and FIG. 11(*b*), the lower surface of the magazine 2 at the fore end part of the latter comes in contact with the upper surface of papers 6 to be stapled together on the stapling board 5 without any possibility that the magazine 2 is turnably displaced further in the downward direction. In contrast with the magazine 2, since the driving links 11 can turnably be driven further in the downward direction, the pulling pawl 54 on the fore lever portion 53 is engaged with a pawl teeth on the fore side of the ratchet 52, causing the foregoing pawl teeth to be depressed. Thus, the ratchet 52 is stepwise rotated in the forward direction. As the driving links 11 are turnably driven in the upward direction, after a substantially inverted U-shaped staple located at the foremost end of each sheet-shaped staple 27*a* is struck by the driver 32, the magazine 2 is turnably driven in the upward direction. The magazine 2 is stopped in the course of the turning movement thereof in the upward direction when the projections 22 projected sideward of the magazine 2 are engaged with the arc-shaped arms 23 standing upright above the base frame 1. In contrast with the magazine 2, since the driving links 11 can turnably be driven further in the upward direction, the two pulling pawls 55 and 56 on the rear lever portion 53 are successively engaged with the pawl tooth on the rear side of the ratchet 52 in the course of the turning movement of the driving links 11 in the upward direction, causing the foregoing pawl tooth to be raised up as shown in FIG. 11(*c*) and FIG. 11(*d*). Thus, the ratchet 52 is stepwise rotated in the forward direction. Since the ratchet 52 is repeatedly stepwise rotated in the above-described manner every time the magazine 2 is turnably displaced in the upward or downward directions the feeding roller 50 is increasingly rotated in the forward direction. Thus, as the feeding roller 50 is stepwise rotated in the forward direction in that way, each sheet-shaped staple 27*a* is delivered in the forward direction in the presence of the frictional resistance arising from the feeding roller 50 and the sheet-shaped staple 27*a* while it comes in contact with the feeding roller 50 and after it is taken from the staple cartridge 4 by the first feeding unit A.

It should be added that since the feeding roller 50 is stepwise rotated by two pulling pawls 55 and 56 on the rear lever portion 53*b*, the lowermost sheet-shaped staple 27 can be displaced in the forward direction with an ample quantity of feeding thereof. After the first sheet-shaped staple 27 is delivered to the forming/striking section 26, it is required that the feeding roller 50 is rotated merely by an angle corresponding to the length of each subsequent sheet-shaped staple 27 every time the magazine 2 is turnably displaced in the upward/downward direction (which represents one cycle of a staple feeding operation). In the case where a subsequent sheet-shaped staple 27 is delivered in the forward direction with an excessive intensity of thrusting power, the feeding roller 50 is idly rotated while thrusting it in the forward direction. Thus, there does not arise a malfunction that each sheet-shaped staple 27 is escapably displaced in the opposite direction to the direction of feeding thereof, i. e., in the rearward direction under the influence of the load developed when a straight staple located at the forward end of each substantially inverted U-shaped staple 27 is struck by the driver 32 and then penetrated through papers 6 to be stapled together on the stapling board 5.

In addition, as shown in FIG. 11(*c*), since the upper pulling pawl 55 on the rear lever portion 53*b* is brought in engagement with the rachet 52 ahead of the pushing pawl 54 on fore lever portion 53*a*, the ratchet lever 53 is displaced from the lower end position in the upward direction. The frictional power developed when the pushing pawl 54 on the fore lever portion 53*a* is engaged with the ratchet 52 immediately after the engagement of the upper pulling pawl 55 on the rear lever portion 53*b* with the same can reliably prevent the ratchet 52 from being rotated in the reverse direction.

As is apparent from the above description, with the staple feeding mechanism constructed in the above-described manner, there does not arise a necessity for arranging a biasing unit for normally biasing the ratchet lever 53 toward the ratchet 52 side like the conventional staple feeding mechanism. In addition the staple feeding mechanism of the present invention is simple in structure, since the ratchet 52 is stepwise rotated with the aid of the pushing pawl 54 on the fore lever portion 53*a* and both the pulling pawls 55 and 56 on the rear lever portion 53*b* every time the driving links 11 are turnably driven in the upward or downward directions. Another advantageous effect is that the quantity of feeding of each sheet-shaped staple 27 attainable by a single stroke of the driving links 11 can substantially be increased.

As is apparent from the above description, when each sheet-shaped staple 27*a* is taken from the staple cartridge 4 with the aid of the first feeding unit A every time the magazine 2 is turnably displaced in the upward/downward direction, the lower surface of the staple 27*a* at the fore end part of the same comes in contact with the feeding roller 50 of the second feeding unit B so that the sheet-shaped staple 27*a* is delivered further in the forward direction with the aid of the second feeding unit B. In other words, the lowermost staple 27*a* is delivered in the forward direction in the rear side range with the aid of the first feeding unit A, and subsequently, it is delivered further in the forward direction in the fore side range with the aid of the second feeding unit B. Thus, even in case that the intermediate part of each sheet-shaped staple 27*a* is excessively bent or broken for some reason, it can be fed to the foremost end of the magazine 2 without fail.

Since a thickness of the papers 6 to be stapled together is not always constant, the motor driven stapler constructed in the above-described manner is equipped with a paper thickness adjusting mechanism as described below.

Figure 17:
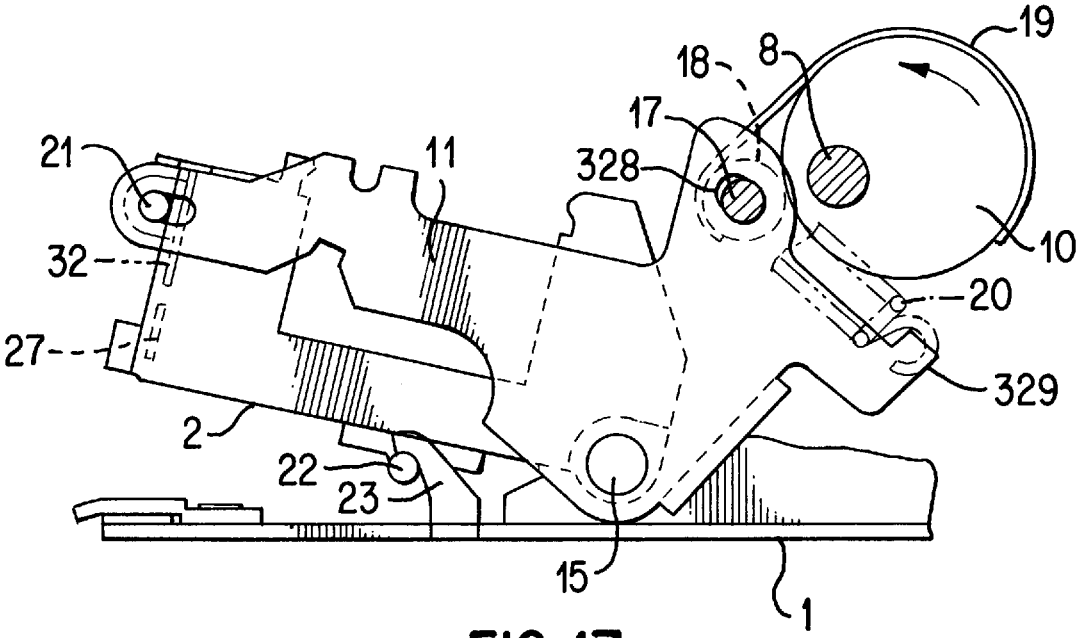
FIG. 17 is a side view of the motor driven stapler at the time when a paper stapling operation is started.

As shown in FIG. 5 and FIG. 17, the roller shaft 17 for the cam roller 18 is loosely fitted through elongated holes 328 which are formed at the upper parts of the driving links 11 while extending in the substantially longitudinally direction of the driving links 11. Tension springs 20 are bridged between the roller shaft 17 and engagement pieces 329 formed behind the elongated holes 328 of the driving links 11. When the driving links 11 are held at the upper positions, the roller shaft 17 comes in contact with the rear ends of the elongated holes 328. On the contrary, when the driving link 11 is actuated in the downward direction, causing a predetermined magnitude of clinching load to be exerted on the staple 27, the tension springs 20 are loosened so that the roller shaft 17 comes in contact with the fore ends of the elongated holes 328. It should be noted that the clinching load is usually set to the maximum value so that the papers to be stapled together may have the largest possible thickness.

Figure 18:
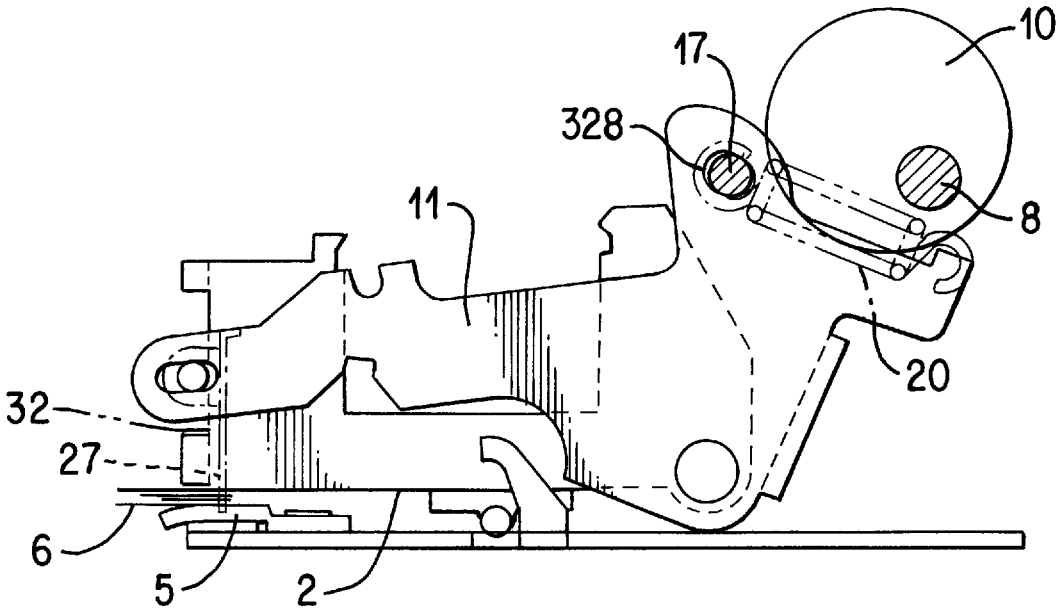
FIG. 18 is a side view of the motor driven stapler in the intermediate state of the paper stapling operation.
Figure 19:
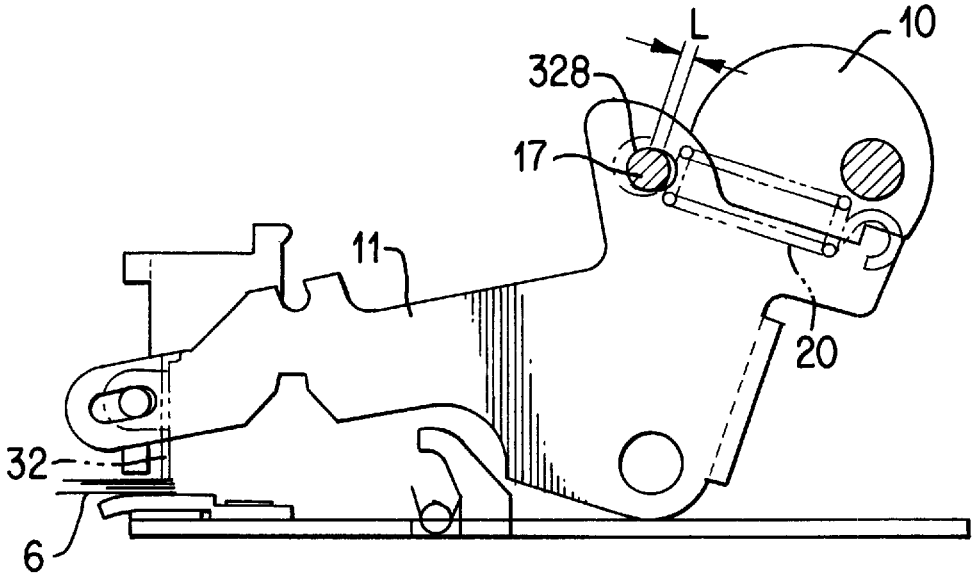
FIG. 19 is a side view of the motor driven stapler at the time when the stapling operation is completed.

With the paper thickness adjusting mechanism constructed as described above, the eccentric cam 10 is rotated and the force is transmitted to the roller shaft 17, causing the driving links 11 to be actuated. While the actuating load of the driving links 11 is less than the set load to each tension spring 20, the roller shaft 17 is held in the operative state when it comes in contact with the rear ends of the elongated holes 328 on the driving links 11. Subsequently, when the actuating load of the driving links 11 is largely increased after the driver 32 starts a clinching operation for allowing the feet of a single staple 27 to be penetrated through papers 6 and then bent, the driving links 11 cannot be actuated any more. This results in the turning movement of the driving links 11 being stopped (see FIG. 18). However, since the eccentric cam 10 continues to thrust the roller shaft 17, the roller shaft 17 moves in the elongated holes 328 in the forward direction so that the tension springs 20 are loosened and expanded. The papers 6 to be stapled together with the maximum preset thickness, assume a predetermined magnitude of clinching load at the time when the roller shaft 17 comes in contact with the foremost ends of the elongated holes 328 due to the loosening of the tension springs 20 or when the driving links 11 are actuated by the resilient force of the tension springs 20. When the actuating load given by the driving links 11 exceeds the predetermined magnitude of clinching load, the tension springs 20 are fully loosened while the roller shaft 17 comes in contact with the foremost ends of the elongated holes 328, resulting in the tension springs 20 failing to be loosened any more. At this time, as shown in FIG. 19, the roller shaft 17 directly thrusts and drives the driving links 11 which in turn actuates the driver 32 until the feet of the staple 27 are folded so as to complete a stapling operation. As is apparent from the drawing, since each tension spring 20 is not deflected in excess of a predetermined quantity L of deflection, there does not arise a malfunction such that abnormally large sound is generated with the tension springs 20.

Figure 20:
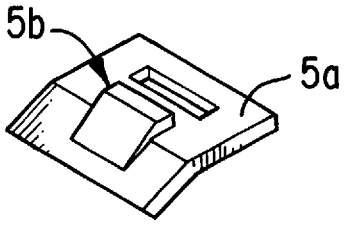
FIG. 20 is a perspective view of a modified stapling board of the motor driven stapler according to the present invention.
Figure 21A:
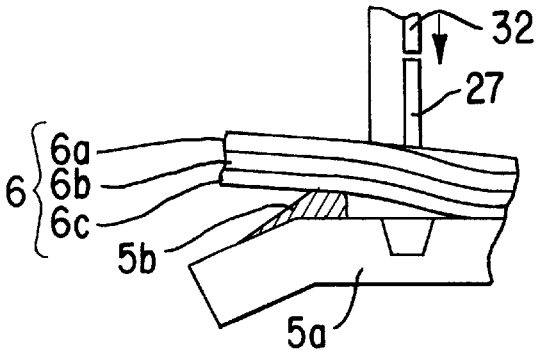
FIG. 21(*a*), FIG. 21(*b*) and FIG. 21(*c*) show an operation of the modified stapling board shown in FIG. 20.
Figure 21B:
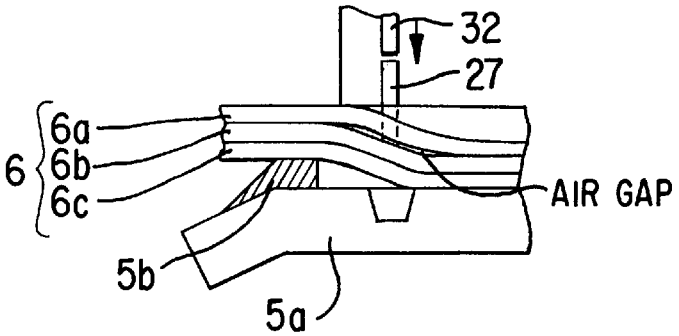
Figure 21C:
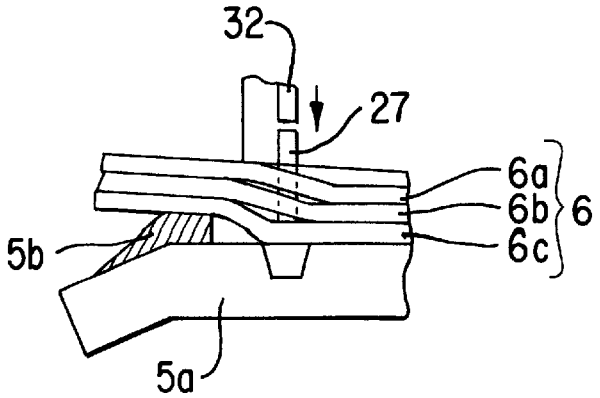

Although, in the above-mentioned embodiment of the present invention, the stapling board 5 having a conventional configuration is utilized, the stapling board 5 can be modified so as to reduce a penetrating resistance force of the paper 6 when the staple 27 is forced through the papers 6. As shown in FIG. 20, a modified stapling board 5*a* is provided with a projecting portion 5*b* on which the papers 6 are put. As shown in FIG. 21(*a*), the papers 6 are not directly in close contact with the surface of the stapling board 5*a* due to the provision of the projecting portion 5*b* when the ends of staple 27 are brought in contact with the papers 6, so that a portion of the papers 6 are bent by being subjected to a driving force applied to staple 27. In addition, as shown in FIG. 21(*b*), when remaining papers 6*b* and 6*c* after penetrating the upper most paper 6*a* of the papers 6 are subjected to the driving force and are further bent, a air gap is generated between the upper most paper 6*a* and the remaining papers 6*b* and 6*c*. When the driving force reaches a penetrating resistance forced of the remaining papers 6*b* and 6*c*, the staple 27 is force into the second upper most paper 6*b*. Further, as in FIG. 21(*c*), the staple is 27 is forced into the remaining paper 6*c* after forming an air gap therebetween in the same manner as described above. That is, the projecting portion 5*b* has a function for separating the papers 6 from the another when the staple is forced through the papers 6 as shown in FIGS. 21(*a*), 21(*b*) and 21(*c*), so that a penetrating resistance force of the papers can be dispersed. Thus, a peak value of the penetrating resistance force can be lowered when compared to the conventional stapling board 5.

While the present invention has been described above with several preferred embodiments thereof, it should of course be understood that the present invention should not be limited only to these embodiments but various changes or modification may be made without departure from the scope of the present invention as defined by the appended claims.

What is claimed is:

1. A stapler comprising:

a staple cartridge for receiving a plurality of sheets of staples wherein each sheet comprises four sides. a top portion. and a bottom portion:

a magazine movable between a first and second position and capable of receiving said staple cartridge:

a first feeding unit slidably mounted within said magazine and including a supporting position immovably disposed at a position behind the magazine, the first feeding unit comprising a spring member which moves said first feeding unit to engage with at least one of said sides of lowermost sheet of said sheets of staples in response to movement of said magazine from said first position to said second position so that said lowermost sheet is moved relative to others of said sheets of staples and thereby positioned to enable staples within said lowermost sheet to be formed and said first feeding unit engages said at least one of said side for the duration of said engagement with said lowermost sheet of staples: and a second feeding unit for forming at least one staple and feeding said at least one staple into an article to be stapled when said magazine is moved from said second position to said first position.

2. A motor driven stapler for driving staples from a sheet of staples having a foremost end and a rearmost end, comprising:

a magazine comprising a foremost and rear end, a forming plate, a driver, a feeding roller, a ratchet lever, and a staple cartridge fitting portion with foremost and rearmost walls;

a staple cartridge for receiving a plurality of sheets of staples including a lowermost sheet of staples wherein each sheet comprises four sides, a top portion, and a bottom portion and said cartridge is fixedly mounted in said magazine;

a base frame, said magazine being mounted to said base frame so as to allow for rotating said magazine with respect to said base frame in upward and downward directions;

a means for stapling papers with at least one staple from said sheet of staples in which said staple, located at the foremost end of said sheet of staples, is delivered to the foremost end of said magazine and said staple is formed by said forming plate to exhibit a substantially inverted U-shaped contour and then struck by a driver toward said base frame so as to allow said staple to penetrate through the papers to be stapled together;

a first feeding unit for feeding said lowermost sheet of staples over a predetermined distance by engaging at least one of said sides for said predetermined distance so as to allow a staple to be taken from said staple cartridge when said magazine is rotated;

a second feeding unit for farther feeding said staple from said first feeding unit in a direction toward said paper stapling means;

said first feeding unit comprises:

a movable feeding member slidably mounted within said magazine and having a surface that engages at least one of said sides of said lowermost sheet of staples when said magazine is turned in the upward direction, wherein the surface of the movable feeding member comprises a contact portion which engages at least one of said sides in the course of the displacement of said movable feeding member in said feeding direction; and an engaging member which moves said movable feeding member in a direction opposite to a feeding direction when said magazine is turned in the downward direction and includes a supporting portion immovably disposed at a position behind the magazine.

3. A motor driven stapler according to claim 2, in which said second feeding unit comprises:

a feeding roller disposed at a position directly below said staple cartridge;

a ratchet operatively associated with said feeding roller, said ratchet being disposed on a side of said magazine; and a ratchet lever fixedly secured to a driving link for rotating said ratchet when said magazine is rotated.

4. A motor driven stapler according to claim 2, further comprising:

a means for reducing a stapling force required to penetrate papers to be stapled.

5. A motor driven stapler according to claim 2, further comprising:

a spring means mounted between said magazine and said movable feeding member so as to allow said movable feeding member to slidably move in said feeding direction when said magazine is turned in the upward direction and said feeding member is released from the engaged state caused by the engagement of said movable feeding member with said supporting portion.

* * * * *